US008790083B1

(12) United States Patent
Liang

(10) Patent No.: US 8,790,083 B1
(45) Date of Patent: Jul. 29, 2014

(54) TURBINE AIRFOIL WITH TRAILING EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 510 days.

(21) Appl. No.: 12/619,774

(22) Filed: Nov. 17, 2009

(51) Int. Cl.
*F01D 5/18* (2006.01)

(52) U.S. Cl.
USPC ..... 416/97 R

(58) Field of Classification Search
USPC ..... 416/95, 96 R, 97 R; 415/115
See application file for complete search history.

(56) References Cited

U.S. PATENT DOCUMENTS 3,844,679 A * 10/1974 Grondahl et al. ..... 416/97 R
5,462,405 A * 10/1995 Hoff et al. ..... 416/97 R
5,601,399 A * 2/1997 Okpara et al. ..... 415/115
5,813,835 A * 9/1998 Corsmeier et al. ..... 416/97 R
6,179,565 B1 * 1/2001 Palumbo et al. ..... 416/97 R
6,254,334 B1 * 7/2001 LaFleur ..... 415/115
6,514,042 B2 * 2/2003 Kvasnak et al. ..... 416/97 R
7,527,474 B1 * 5/2009 Liang ..... 416/1
7,722,327 B1 * 5/2010 Liang ..... 416/97 R
7,753,650 B1 * 7/2010 Liang ..... 416/97 R
8,109,735 B2 * 2/2012 Gage et al. ..... 416/241 R
2002/0021966 A1 * 2/2002 Kvasnak et al. ..... 416/97 R
2005/0053458 A1 * 3/2005 Liang ..... 415/115
2009/0068022 A1 * 3/2009 Liang ..... 416/97 R
2011/0171023 A1 * 7/2011 Lee et al. ..... 416/1
2011/0176930 A1 * 7/2011 Ahmad et al. ..... 416/97 R

* cited by examiner

*Primary Examiner* — Edward Look
*Assistant Examiner* — Christopher R Legendre
(74) *Attorney, Agent, or Firm* — John Ryznic

(57) ABSTRACT

A turbine airfoil, such as a rotor blade or a stator vane, in which a trailing edge region is cooled by a series of modules that extend along the airfoil in the trailing edge region and form a plurality of serpentine flow channels to cool the trailing edge. Each module is separated by partition ribs so that each module can be varied in flow to control metal temperature. The modules are supplied with cooling air from a radial extending cooling supply channel located adjacent to the trailing edge region.

10 Claims, 4 Drawing Sheets view A-A

TURBINE AIRFOIL WITH TRAILING EDGE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine airfoil with trailing edge cooling.

2. Description of the Related Art Including Information Disclosed Under 37 CFR 1.97 and 1.98

A gas turbine engine includes a turbine section with one or more stages of stator vanes and rotor blades that react with a hot gas flow from a combustor to produce mechanical work and, in the case of an industrial gas turbine engine, drive an electric generator. It is known in the art that the engine efficiency can be increased by passing a higher temperature gas flow into the turbine. However, the turbine inlet temperature is limited by the material properties of the first stage airfoils and the amount of cooling provided for these airfoils.

Turbine airfoils are cooled by passing bleed off air from the compressor and through an internal cooling air passage within the airfoil. The cooling air from the compressor used for airfoil cooling is discharged from the airfoil without producing any useful work. Thus, the engine efficiency is reduced because the work used to compress the air used for airfoil cooling is lost. Therefore, it is also desirable to make use of a minimal amount of compressed air from the compressor used for airfoil cooling.

An airfoil is exposed to different temperatures due to the shape and the flow pattern across the airfoil. The hot gas flow strikes the leading edge of the airfoil and then flows around to the pressure side and the suction side. The trailing edge of the airfoil is the thinnest portion of the airfoil and is also exposed to some of the highest temperatures. Because of this, it is difficult to design for a cooling circuit for the trailing edge region. In the prior art, the trailing edge region of an airfoil is cooled by passing cooling air through channels that include pin fins to increase the heat transfer rate. FIG. 1 shows a prior art turbine airfoil for a first stage rotor blade with a row of drilled cooling air holes formed along the trailing edge of the blade. FIG. 2 shows a cross section view from the top of the FIG. 1 blade. The FIG. 1 design uses a single pass axial flow cooling channel to supply cooling air for the trailing edge region of the airfoil. The remaining sections of the airfoil are cooled with a separate serpentine flow cooling circuit. However, the single pass axial flow cooling design is not the best method for utilizing cooling air and therefore results in a low convective cooling effectiveness for the airfoil.

BRIEF SUMMARY OF THE INVENTION

It is an object of the present invention to provide a turbine airfoil with a trailing edge cooling circuit that has an improved cooling effectiveness over that of the prior art.

It is another objective of the present invention to provide for a turbine airfoil with a reduced trailing edge metal temperature so that a reduced cooling air flow is required for the airfoil.

The above objectives and more are achieved with turbine airfoil of the present invention in which a new trailing edge region cooling circuit can be used in a prior art airfoil. The trailing edge cooling circuit includes multiple mini-serpentine cooling passages that extend along the trailing edge of the airfoil and connect with a radial extending cooling air supply channel formed adjacent to the trailing edge region. Each individual module can be designed based on the airfoil local external heat load to achieve a desired local metal temperature. The multiple mini-serpentine flow modules can be designed as a three-pass parallel flow serpentine network or a four or five-pass serpentine flow network.

DETAILED DESCRIPTION OF THE INVENTION

Figure 1:
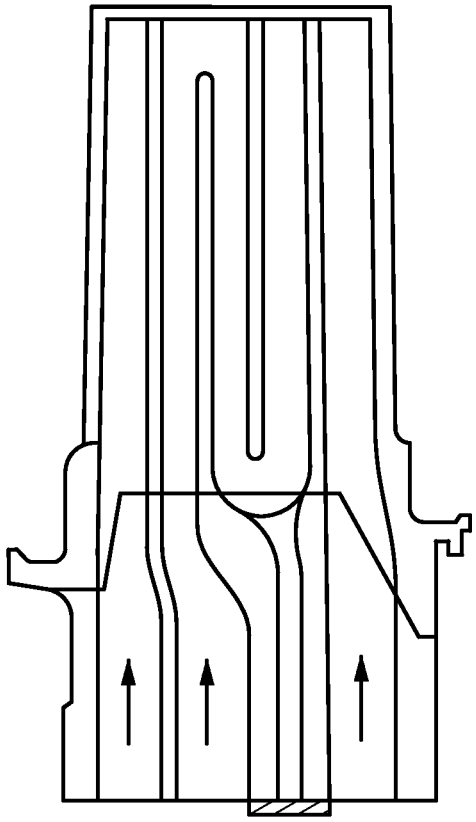
FIG 1 Prior Art
FIG. 1 shows a cross section side view of a prior art turbine rotor blade with a trailing edge region cooling circuit.
Figure 2:
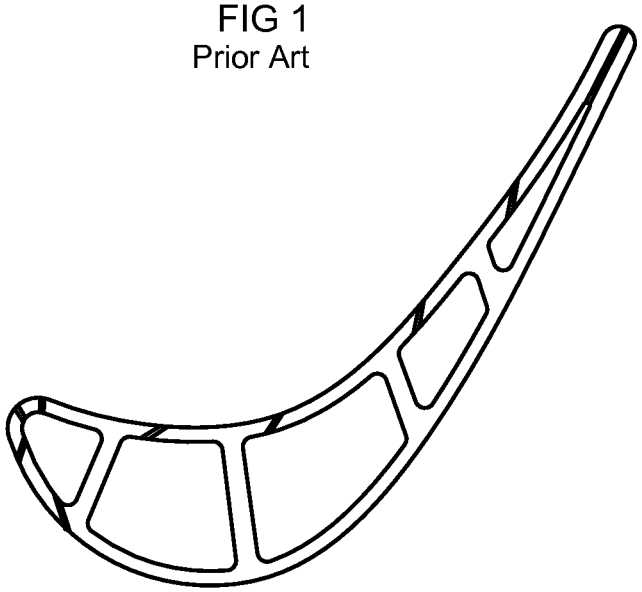
FIG 2 Prior Art
FIG. 2 shows a cross section top view of the turbine rotor blade of FIG. 1.
Figure 3:
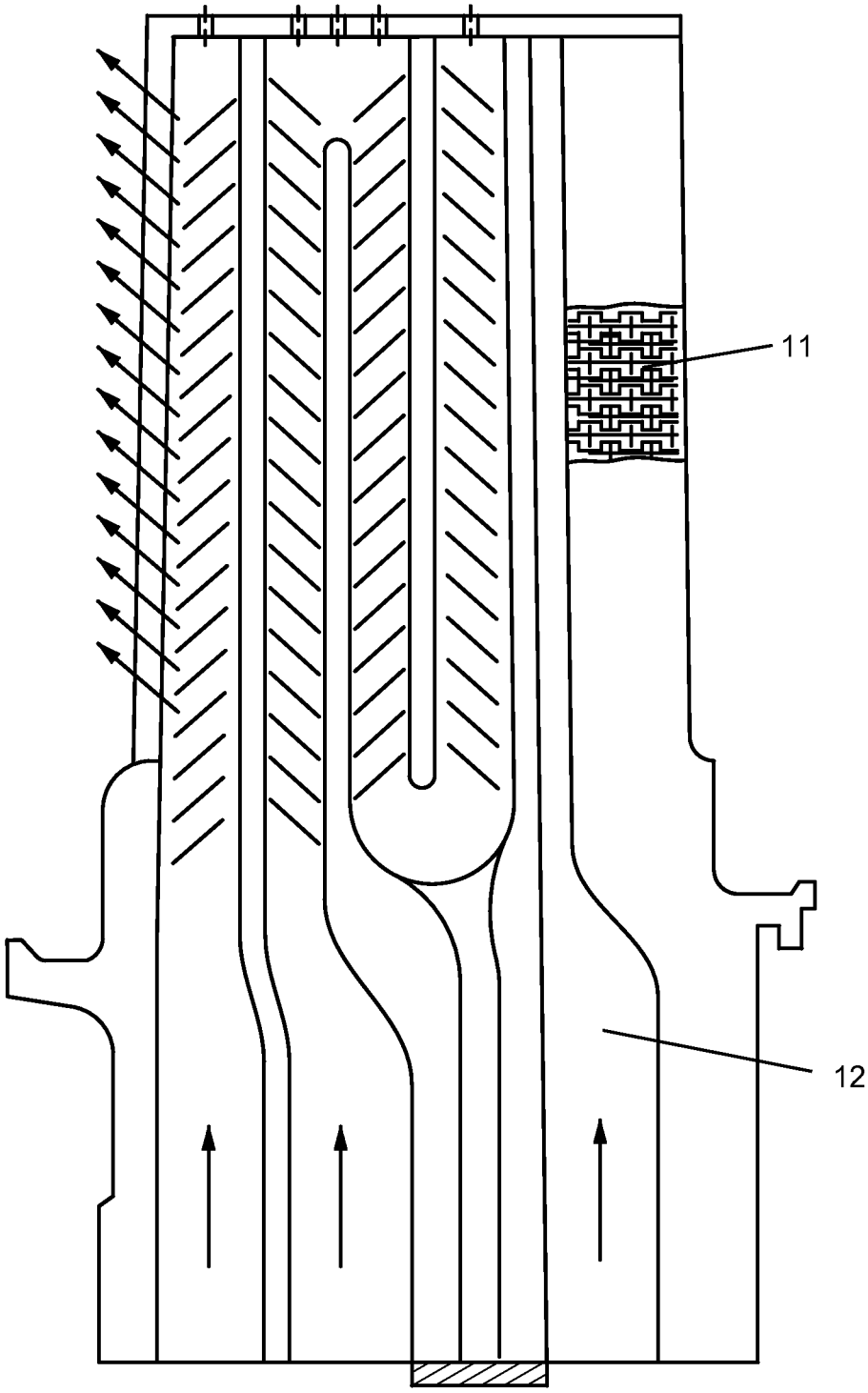
FIG. 3 shows a cross section side view of the turbine rotor blade cooling circuit for the present invention.

The trailing edge cooling circuit of the present invention is shown in a turbine rotor blade but could also be used in a turbine stator vane. FIG. 3 shows a turbine rotor blade with a serpentine flow cooling circuit for cooling a middle section of the airfoil and includes a three-pass aft flowing serpentine flow circuit that discharges at the blade tip through tip cooling holes, and a leading edge cooling circuit that includes a leading edge cooling air supply channel that supplies cooling air to the leading edge through a row of metering and impingement holes. Film cooling holes arranged in the showerhead design are used to provide film cooling for the leading edge. The present invention adds the features of an arrangement of mini-serpentine flow cooling modules 11 along the trailing edge region of the airfoil that are all connected to a radial extending cooling air supply channel 12 that supplies cooling air to these modules 11. The modules 11 extend along the entire trailing edge region of the blade.

Figure 4:
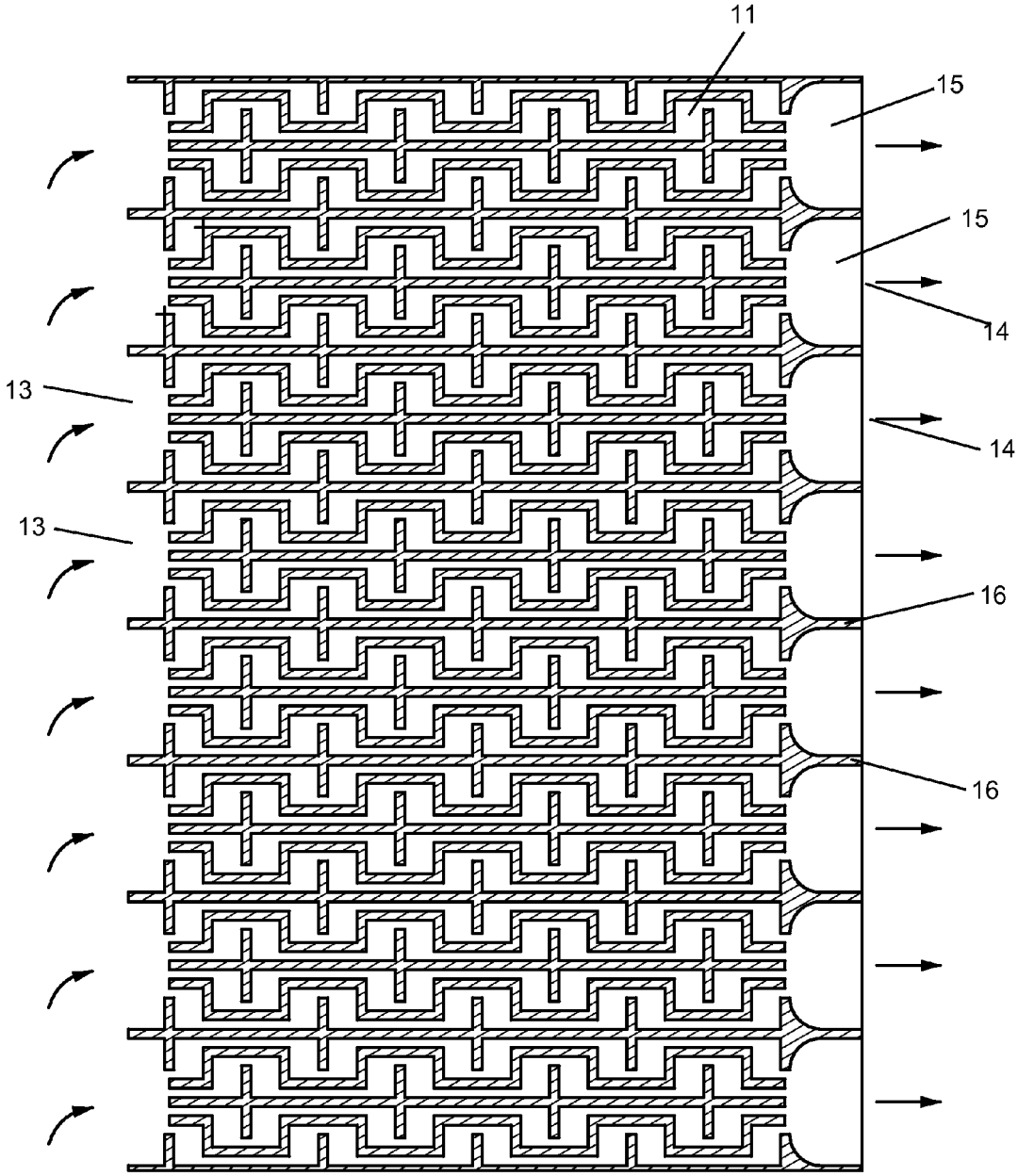
FIG. 4 shows a cross section close up view of the multiple mini-serpentine flow cooling circuit used in the trailing edge region of the present invention.

FIG. 4 shows a section of the T/E mini-serpentine flow cooling modules of the present invention in an enlarged view. Each module 11 includes an inlet end 13 and an outlet end 14 for the cooling air that is supplied from the radial T/E channel 12. Each module 11 forms a separate cooling air channel from adjacent modules such that adjacent modules do not fluidly communicate with one another. Each module 11 forms a serpentine flow passage for the cooling air from the inlet end 13 to the outlet end 14 in order to significantly increase the heat transfer coefficient over that disclosed in the cited prior art reference. The outlet for each module 11 includes a diffusion slot 15 that opens onto the T/E surface preferably on the pressure side wall of the airfoil. Each module is separated by a horizontal extending partition rib 16 that extends from the inlet end 13 to the outlet end 14 of the modules 11.

Figure 5:
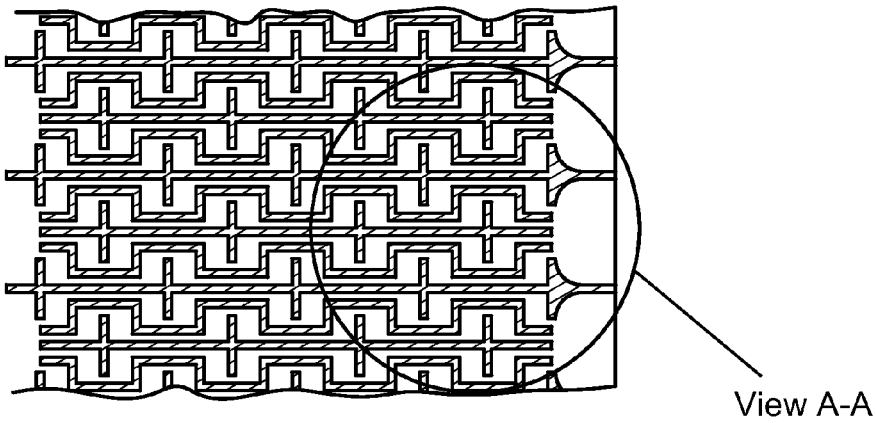
FIG. 5 shows a section of the trailing edge cooling circuit of FIG. 4 for the present invention.
Figure 6:
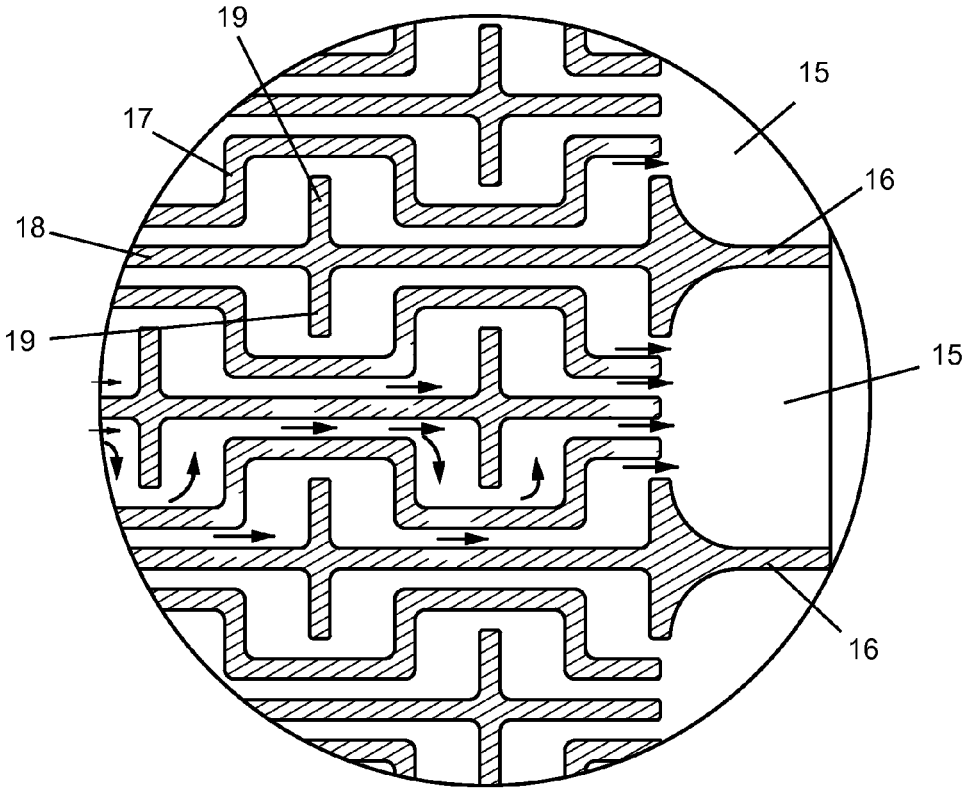
FIG. 6 shows an enlarged section of the trailing edge cooling circuit from FIG. 5.

FIG. 6 shows an enlarged section of the T/E cooling circuit of FIG. 5 which is a section of the mini-serpentine flow modules of FIG. 4. The modules 11 include the exit diffusion slot 15 on the outlet end. The horizontal extending partition ribs 16 separate each adjacent module 11 so that cooling air from one module will not flow into another module. Thus, the pressure in one module can be different from the pressure in another module. Within the modules 11 are zigzag ribs 17 that form a serpentine flow passage with an adjacent straight rib 18 that includes outward extending projections 19 that extend into the cavities formed by the zigzag shaped ribs 17 as seen in FIG. 6. The ribs 17 and 18 form openings for the cooling air on the outlet end that open into the diffusion slot 15. The main purpose of the various shaped ribs within the T/E circuit is to redirect the cooling air flow to produce a serpentine flow passage for increasing the heat transfer coefficient. Corners of the ribs 17 and 18 are rounded so that the cooling air flows through without forming stagnant areas. When a stagnant area of cooling air flow is formed, the cooling air acts like an insulator so that the heat transfer coefficient becomes very low. This is where hot zones can occur in the airfoil.

The zigzag paths formed by the arrangement of ribs within each module forms a serpentine flow path in which the cooling air flows upward in the blade radial direction and then turns 180 degrees and flows downward, repeating this number of times until the cooling air is discharged into the diffusion slot 15. The ribs extend generally in a radial direction of the blade and form legs of the serpentine flow channel in which the legs flow in a radial upward direction and a radial downward direction. As the cooling air flows toward the T/E, the cooling air will hit a section of a rib and produce impingement cooling. The cooling air that flows upward will strike the rib separating that serpentine flow path from an adjacent serpentine flow path to produce impingement cooling. Since the ribs extend in the serpentine flow path and across the walls of the airfoil, heat from the hot metal surface will be conducted into the ribs and transmitted to the cooling air flow from the impingement cooling.

The ribs that form the serpentine flow cooling channels within the trailing edge region of the airfoil can be formed by casting when the blade is cast, or can be formed by machining the ribs into two half sections that can then be bonded together to form the single piece blade. Also, the blade can be cast with one side of the T/E region formed with the cast blade in which the other side of the T/E region is left open. The T/E cooling circuit with the ribs can then be closed by bonding an airfoil surface to the ribs and form the remaining section of the blade. In this procedure, the ribs can be cast along with the T/E section, or the ribs can be machined.

Major design features and advantages of the T/E cooling circuit of the present invention over the prior art trailing edge cooling design as described below. The multiple mini-serpentine flow path cooling channels are formed by an overlap of multiple mini ribs positioned at staggered array and perpendicular to the cooling flow along the cooling flow channel. Cooling air flows axially perpendicular to the airfoil span. This is different from the prior art serpentine flow cooled rotor blade in which the serpentine channel is perpendicular to the engine centerline and the cooling air flows radial inward and outward along the blade span. The spent cooling air from an upward flowing channel will return heated air back down to the blade root section in this prior art design.

For the multiple mini-serpentine flow channels, as the cooling air flows toward the blade T/E exit holes or slots, the cooling air will impinge onto the partition ribs and therefore create a very high rate of internal heat transfer coefficient. In addition, as the cooling air turns in the mini-serpentine flow channels, cooling air changes momentum to produce an increase in the heat transfer coefficient. The combination effects create a high cooling effectiveness for the multiple turns in the mini-serpentine flow channels for a blade cooling design.

The multiple mini-serpentine flow channels can be designed to tailor the airfoil external heat load by means of varying the channel height as well as the cross sectional flow area at the middle of the turn for each module. A change in rib spacing and/or rib height will also impact the cooling flow mass flux which will alter the internal heat transfer coefficient and metal temperature along the flow path.

I claim:

1. An air cooled turbine airfoil comprising:

a pressure side wall and a suction side wall;

a serpentine flow cooling circuit formed within the pressure side and suction side walls to provide cooling for the airfoil;

a radial extending cooling air channel formed adjacent to a trailing edge region of the airfoil;

a plurality of serpentine flow channels formed within the trailing edge region of the airfoil and connected to the radial extending cooling air channel;

the serpentine flow channels having a plurality of radial upward legs and a plurality of radial downward legs;

the airfoil includes a plurality of modules extending along the trailing edge of the airfoil;

each module being separated by a partition rib; and, each module having a plurality of serpentine shaped ribs to form a plurality of serpentine flow channels within the trailing edge region of the airfoil.

2. The air cooled turbine airfoil of claim 1, and further comprising:

the plurality of serpentine flow channels open into a diffusion duct located on one side of the airfoil wall adjacent to a trailing edge of the airfoil.

3. The air cooled turbine airfoil of claim 1, and further comprising:

the plurality of serpentine flow channels for each module discharges into a separate diffusion slot.

4. The air cooled turbine airfoil of claim 3, and further comprising:

each serpentine flow channel is formed with three serpentine flow channels that open into a diffusion slot.

5. The air cooled turbine airfoil of claim 1, and further comprising:

the plurality of serpentine flow channels extend across the airfoil from the pressure side wall to the suction side wall within the trailing edge region of the airfoil.

6. The air cooled turbine airfoil of claim 1, and further comprising:

each module includes a middle rib extending along a chordwise direction of the airfoil, the middle rib including radial extending ribs; and, a zigzag rib on each side of the middle rib in which the ribs extend in the radial direction and the chordwise direction.

7. An air cooled turbine airfoil comprising:

a pressure side wall and a suction side wall;

a trailing edge region;

first and second horizontal extending partition ribs formed in the trailing edge region and forming a closed cooling air passage from an inlet end to an outlet end that opens into a diffusion slot;

first and second zigzag shaped ribs extending in the cooling air passage between the first and second horizontal extending partition ribs;

a straight rib extending in the cooling air passage between the first and second zigzag shaped ribs; and, the first and second horizontal extending partition ribs and the straight rib all three include outward extending projections that form impingement cooling surfaces and produce a serpentine flow path for cooling air flowing through the cooling air passage from the inlet end to the outlet end.

8. The air cooled turbine airfoil of claim 7, and further comprising:

the zigzag shaped ribs have elbows that are 90 degrees.

9. The air cooled turbine airfoil of claim 7, and further comprising:

the straight rib and the zigzag shaped ribs all three have outlet ends that end at an opening of the diffusion slot.

10. The air cooled turbine airfoil of claim 7, and further comprising:

the airfoil includes a plurality of modules each formed by horizontal extending partition ribs with zigzag shaped ribs and a straight rib within a closed cooling air passage that opens into a diffusion slot; and, the straight ribs and the horizontal extending partition ribs include outward extending projections that form impingement surfaces and a serpentine flow path within the closed cooling air passages from an inlet end to the diffusion slots.

* * * * *